US011568807B2

(12) United States Patent
Chu et al.

(10) Patent No.: US 11,568,807 B2
(45) Date of Patent: Jan. 31, 2023

(54) DISPLAY SUBSTRATE, METHOD FOR DRIVING THE SAME AND DISPLAY DEVICE

(71) Applicants: Chengdu BOE Optoelectronics Technology Co., Ltd., Sichuan (CN); BOE TECHNOLOGY GROUP CO., LTD., Beijing (CN)

(72) Inventors: Zhiwen Chu, Beijing (CN); Xiangdan Dong, Beijing (CN); Bo Zhang, Beijing (CN); Yulong Wei, Beijing (CN)

(73) Assignees: Chengdu BOE Optoelectronics Technology Co., Ltd., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/434,068

(22) PCT Filed: Jan. 29, 2021

(86) PCT No.: PCT/CN2021/074452
§ 371 (c)(1),
(2) Date: Aug. 26, 2021

(87) PCT Pub. No.: WO2021/164525
PCT Pub. Date: Aug. 26, 2021

(65) Prior Publication Data

US 2022/0139314 A1 May 5, 2022

(30) Foreign Application Priority Data

Feb. 17, 2020 (CN) ..... 202010097265.3

(51) Int. Cl.
*G09G 3/3225* (2016.01)

(52) U.S. Cl.
CPC ... *G09G 3/3225* (2013.01); *G09G 2300/0439* (2013.01); *G09G 2320/0233* (2013.01)

(58) Field of Classification Search
CPC ..... G09G 3/3225; G09G 2300/0465
See application file for complete search history.

(56) References Cited

U.S. PATENT DOCUMENTS

2018/0090061 A1* 3/2018 Kim ..... H01L 27/3288
2018/0129106 A1* 5/2018 Gao ..... G09G 3/3648
(Continued)

FOREIGN PATENT DOCUMENTS

CN 107611142 A 1/2018
CN 107871767 A 4/2018
(Continued)

OTHER PUBLICATIONS

China Patent Office, CN202010097265.3 First Office Action dated Nov. 3, 2020.
(Continued)

*Primary Examiner* — Hang Lin
(74) *Attorney, Agent, or Firm* — Houtteman Law LLC

(57) ABSTRACT

A display substrate, a method for driving a display substrate and a display device are provided. The display substrate includes a display area, pixel units are arranged in the display area, the display area includes a first area and a second area which are arranged along a second direction, quantities of the pixel units arranged along the first direction in the first area are the same, and a quantity of the pixel units in any row in the second area is less than that of the pixel units in any row in the first area; the display substrate further includes a compensation area, a load compensation unit is arranged in the compensation area, the gate line in the second area and the data line in the first area extend to the
(Continued)

compensation area, and the load compensation unit is coupled with the gate line and the data line.

15 Claims, 2 Drawing Sheets

(56) References Cited

U.S. PATENT DOCUMENTS

| | | | | |
|---|---|---|---|---|
| 2018/0166018 | A1 | 6/2018 | Yang | |
| 2018/0219058 | A1* | 8/2018 | Xiang | H01L 27/3225 |
| 2019/0214596 | A1 | 7/2019 | Park | |

FOREIGN PATENT DOCUMENTS

| | | | |
|---|---|---|---|
| CN | 107887424 | A | 4/2018 |
| CN | 108010947 | A | 5/2018 |
| CN | 108417172 | A | 8/2018 |
| CN | 108493227 | A | 9/2018 |
| CN | 108646486 | A | 10/2018 |
| CN | 108682373 | A | 10/2018 |
| CN | 109061975 | A | 12/2018 |
| CN | 109471306 | A | 3/2019 |
| CN | 109741709 | A | 5/2019 |
| CN | 109767718 | A | 5/2019 |
| CN | 111243524 | A | 6/2020 |
| EP | 3282441 | A2 | 2/2018 |
| KR | 20190079803 | A | 7/2019 |

OTHER PUBLICATIONS

China Patent Office, CN202010097265.3 Second Office Action dated Apr. 7, 2021.

China Patent Office, CN202010097265.3 Decision of Rejection dated Jul. 16, 2021.

* cited by examiner

DISPLAY SUBSTRATE, METHOD FOR DRIVING THE SAME AND DISPLAY DEVICE

CROSS REFERENCE TO RELATED APPLICATIONS

This application claims priority to Chinese patent application No. 202010097265.3, filed on Feb. 17, 2020, the contents of which are incorporated herein by reference in their entirety.

TECHNICAL FIELD

The present disclosure relates to the field of display technology, and particularly relates to a display substrate, a method for driving a display substrate and a display device.

BACKGROUND

A shape of a display screen may vary, for example, may be a rounded rectangle, or may have a special-shaped area. For a round-corner rectangular display screen, quantities of pixels of adjacent rows are different at a round-corner area; for a display screen with a special-shaped area, quantities of pixels of adjacent rows at the special-shaped area are different. A load of the row with a smaller quantity of pixels is smaller, a load of the row with a larger quantity of pixels is larger, charging time durations of the rows of pixels are different due to the fact that loads of the rows are inconsistent, a difference in current of adjacent rows of pixels is relatively large due to the fact that a difference between the charging time durations of the adjacent rows of pixels is relatively large, and when the difference in current exceeds a certain specification, a display brightness of the display screen is unevenness, and a display effect of the display screen is affected.

SUMMARY

The present disclosure provides a display substrate, including a display area, pixel units arranged in an array, gate lines extending along a first direction and data lines extending along a second direction are arranged in the display area, the gate lines and the data lines are crossed, the pixel units arranged along the first direction are coupled through the gate lines, and the pixel units arranged along the second direction are coupled through the data lines;

the display area includes a first area and a second area which are mutually butted, the first area and the second area are arranged along the second direction, quantities of the pixel units arranged along the first direction in the first area are the same, and a quantity of any row of the pixel units arranged along the first direction in the second area is less than that of any row of the pixel units arranged along the first direction in the first area;

the display substrate further includes a compensation area, the compensation area is in butt joint with the second area, a load compensation unit is arranged in the compensation area, the gate line in the second area extends to the compensation area, the data line in the first area extends to the compensation area, and the load compensation unit is coupled with the gate line and the data line.

In some implementations, the load compensation unit compensates a resistance and a capacitance of a load of the gate line.

In some implementations, a difference between a sum of quantities of the pixel units and load compensation units coupled to a first gate line and a sum of quantities of the pixel units and load compensation units coupled to a second gate line adjacent to the first gate line is less than or equal to a difference between the quantity of the pixel units coupled to the first gate line and the quantity of the pixel units coupled to the second gate line.

In some implementations, a sum of a quantity of load compensation units coupled to any gate line in the compensation area and a quantity of the pixel units coupled to the any gate line in the second area is less than or equal to the quantity of the pixel units coupled to each gate line in the first area.

In some implementations, the first direction is a row direction of the array and the second direction is a column direction of the array;

a plurality of rows of pixel units are arranged in the second area, each row of pixel units includes a plurality of pixel units, and quantities of the pixel units in the rows are gradually reduced along a direction of the second area away from the first area;

a plurality of rows of load compensation units are arranged in the compensation area, and the rows of load compensation units are arranged along a direction in which the data line extends; each row of load compensation units includes a plurality of load compensation units, and the load compensation units in each row are arranged along a direction in which the gate line extends;

quantities of the load compensation units in the rows in the compensation area are gradually increased along a direction away from the first area, along the direction away from the first area, the rows of pixel units in the second area correspond to the rows of load compensation units in the compensation area one by one, and the pixel units and the load compensation units in corresponding rows are coupled with the same gate line.

In some implementations, positions of the pixel units in each row in the second area correspond to positions of the load compensation units in each row in the compensation area one by one.

In some implementations, the first area, the second area, and the compensation area are arranged along the second direction.

In some implementations, the second area and the compensation area are arranged along the first direction, and the compensation area is further in butt joint with the first area.

In some implementations, each of the pixel units includes a first pixel driving circuit and a light emitting element;

each load compensation unit includes a second pixel driving circuit, a configuration and a structure of the second pixel driving circuit are the same as those of the first pixel driving circuit, a scan signal input terminal of the second pixel driving circuit is coupled with the gate line, and a data signal input terminal of the second pixel driving circuit is coupled with the data line.

In some implementations, the load compensation unit further includes a first electrode coupled to a voltage stabilization signal terminal;

the first electrode and a cathode or an anode of the light emitting element are made of a same material, and are arranged in a same layer and coupled to each other.

In some implementations, the light emitting element includes an organic light emitting diode, a light emitting diode, a micro light emitting diode, or a mini light emitting diode.

In some implementations, each gate line is input with a scan signal from one end thereof; or, each gate line is input with a scan signal from both ends thereof.

The present disclosure further provides a display device including the display substrate described above.

The present disclosure further provides a method for driving the display substrate described above, the method including: driving the pixel units in the first area to display by scan signals input through gate lines in the first area, and driving the pixel units in the second area to display and driving load compensation units in the compensation area by scan signals input through gate lines in the second area.

In some implementations, the method further includes: driving the load compensation units in the compensation area and the pixel units in the second area, which are coupled to each gate line, simultaneously, by a scan signal input by said each gate line.

DESCRIPTION OF EMBODIMENTS

In order to make those skilled in the art better understand the technical solution of the present disclosure, the display substrate, the method for driving the display substrate, and the display device provided in the present disclosure are described in further detail below with reference to the accompanying drawings and the detailed description.

Figure 1:
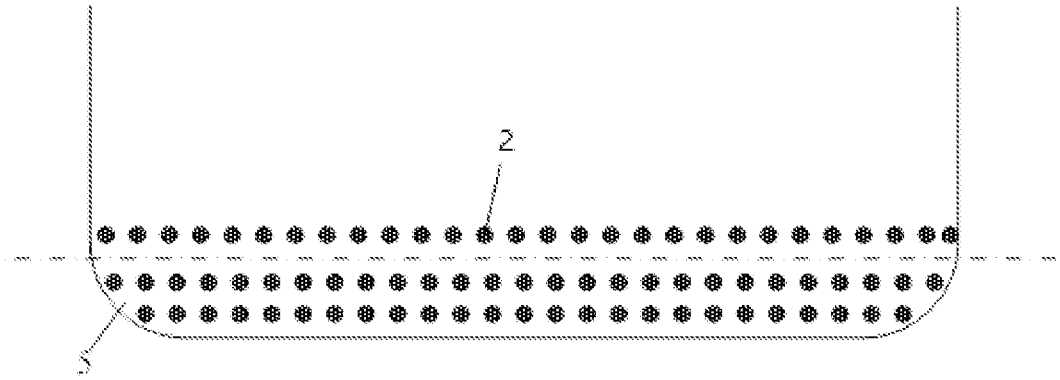
FIG. 1 is a top view of a partial structure of a rounded rectangular display screen.

A shape of a display screen may vary, as shown in FIG. 1, the display screen may be of a rounded rectangle, and quantities of the pixel units 2 in adjacent rows in a rounded corner area 5 may be different, which causes inconsistent loads in the rows, so that charging time durations of the pixel units 2 in the rows are different, and a difference in current exists between the pixel units 2 in adjacent rows, which causes the display screen to have a non-uniform display brightness, and affects a display effect of the display screen.

Certainly, at the rounded corner area 5 shown in FIG. 1, a difference between the quantities of the pixel units 2 in adjacent rows may be not too large (for example, the difference may be one or two pixel units 2), resulting in a gentle transition, so that the display screen may not have a noticeable defect of uneven display brightness.

For a display screen with a special-shaped area, a relatively large difference may exist between quantities of the pixel units in adjacent rows in the special-shaped area (for example, the difference may be four or more pixel units), which causes loads in the rows to be obviously different, so that the charging time durations of the pixel units in the rows are obviously different, and the difference in current between the pixel units in the adjacent rows is relatively large due to the excessively large difference between the charging time durations of the pixel units in the adjacent rows, and when the difference in current exceeds a certain specification, the display screen may have an unevenness display brightness (for example, Mura), which may have a bad effect on the display effect of the display screen.

Therefore, for the display screen in which the quantities of the pixel units in adjacent rows are different, a compensation design needs to be considered so that a difference between loads of the rows of the display screen is not too large, thereby avoiding the display screen from having the defect of uneven display brightness as much as possible.

Figure 2:
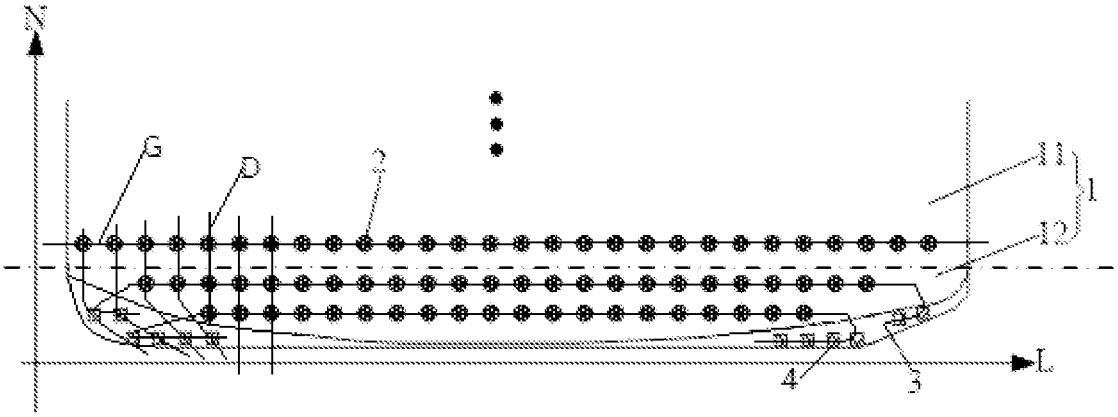
FIG. 2 is a top view of a partial structure of a display substrate according to an embodiment of the present disclosure.

An embodiment of the present disclosure provides a display substrate, as shown in FIG. 2, the display substrate includes a display area 1, pixel units 2 arranged in an array, gate lines extending along a first direction L, and data lines extending along a second direction N are disposed in the display area 1, the gate lines and the data lines are crossed, the pixel units 2 arranged along the first direction L are coupled by the gate line, and the pixel units 2 arranged along the second direction N are coupled by the data line; the display area 1 includes a first area 11 and a second area 12 which are butted with each other, the first area 11 and the second area 12 are arranged along the second direction N, quantities of the pixel units 2, in rows, arranged along the first direction L in the first area 11 are the same, and a quantity of the pixel units 2 in any row arranged along the first direction L in the second area 12 is less than the quantity of the pixel units 2 in any row arranged along the first direction L in the first area 11; the display substrate further includes a compensation area 3, the compensation area 3 is located on a side, away from the first area 11, of the second area 12, load compensation units 4 are arranged in the compensation area 3, the gate line in the second area 12 extends to the compensation area 3, the data line in the first area 11 extends to the compensation area 3, and the load compensation unit 4 is coupled with the gate line and the data line.

In the embodiment, the first direction L is defined as a row direction, the second direction N is defined as a column direction, and the first direction and the second direction intersect and may be mutually perpendicular or not. Since the quantity of the pixel units 2 in any row arranged in the second area 12 along the first direction L is less than the quantity of the pixel units 2 in any row arranged in the first area 11 along the first direction L, a load of each gate line in the second area 12 is usually less than a load of any gate line in the first area 11, which may cause uneven display brightness of the pixel units 2 in the second area 12 and the first area 11, and affect the display effect. It should be noted that the load of the gate line is mainly composed of a resistance of each conductive film layer and/or a capacitance formed between conductive film layers in a driving circuit directly coupled to the gate line and a light emitting element indirectly coupled to the gate line, and therefore, a compensation for the load of the gate line is mainly to compensate the resistance and/or the capacitance of the load of the gate line.

In the embodiment, by providing the compensation area 3 and providing the load compensation unit 4 in the compensation area 3, the load of the gate line in the second area 12 can be compensated (i.e., the resistance and/or the capacitance of the load of the gate line is compensated) to reduce a difference in load between the gate line in the second area 12 and the gate line in the first area 11, and thus the load of the gate line in the second area 12 and the load of the gate line in the first area 11 substantially tend to be the same, and further, the charging time duration of each row of pixel units 2 in the second area 12 tends to be the same as that of each row of pixel units 2 in the first area 11, so that the difference in current between each row of pixel units 2 in the second area 12 and the first area 11 tends to be zero, and finally, the display brightness of the pixel units 2 in the second area 12 and the first area 11 tends to be uniform, uniformity of the display brightness of the display substrate is improved, and the display effect of the display substrate is improved.

In the embodiment, a plurality of rows of pixel units 2 may be disposed in the second area 12, each row of pixel units 2 includes a plurality of pixel units 2, and quantities of the pixel units 2 in the rows may be gradually decreased along a direction of the second area 12 away from the first area 11; in such case, a plurality of rows of load compensation units 4 may be disposed in the compensation area 3, and the plurality of rows of load compensation units 4 may be arranged along a direction in which the data line extends; each row of load compensation units 4 may include a plurality of load compensation units 4, and the load compensation units 4 in each row may be arranged along a direction in which the gate line extends; quantities of the load compensation units 4 in the rows may be gradually increased in a direction of the compensation area 3 away from the second area 12. Thus, for example, along the direction away from the first area 11, the rows of the pixel units 2 in the second area 12 may correspond to the rows of the load compensation units 4 in the compensation area 3 one by one, and the pixel units 2 and the load compensation units 4 in corresponding rows are coupled to the same gate line, so that each row of pixel units 2 in the second area 12, which are reduced in quantity relative to each row of pixel units 2 in the first area 11, can be compensated by a corresponding row of load compensation units 4, so as to reduce the difference in load between the gate lines in the second area 12 and the first area 11, thereby the load of the gate line in the second area 12 and the load of the gate line in the first area 11 substantially tend to be the same, the charging time duration of each row of pixel units 2 in the second area 12 and the charging time duration of each row of pixel units 2 in the first area 11 tend to be the same, the difference in current between each row of pixel units 2 in the second area 12 and each row of pixel units 2 in the first area 11 tends to be zero, and finally the display brightness of the pixel units 2 in the second area 12 and the first area 11 tends to be uniform, the uniformity of the display brightness of the display substrate is improved, and the display effect of the display substrate is improved.

It should be understood that, in a same direction, in response to that the quantity of pixel units 2 in each row in the second area 12 is decreased, the quantity of load compensation units 4 in each row in the compensation area 3 may be increased, the quantity of pixel units 2 in each row in the second area 12 is decreased by an amount corresponding to (e.g., equal to) an increased quantity of load compensation units 4 in each row in the compensation area 3, and in response to that the quantity of pixel units 2 in each row in the second area 12 is not changed, the quantity of load compensation units 4 in each row in the compensation area 3 may also be unchanged.

In some implementations, a difference between a sum of quantities of the pixel units 2 and the load compensation units 4 coupled to a first gate line and a sum of quantities of the pixel units 2 and the load compensation units 4 coupled to a second gate line adjacent to the first gate line is less than or equal to a difference between the quantity of the pixel units 2 coupled to the first gate line and the quantity of the pixel units 2 coupled to the second gate line.

As an example, in the second area 12, the quantity of the pixel units 2 coupled to the first gate line may be different from the quantity of the pixel units 2 coupled to the second gate line adjacent to the first gate line, and the difference therebetween may be relatively large (for example, the difference may be four or more pixel units), but the difference between the sum of the quantities of the pixel units 2 and the load compensation units 4 coupled to the first gate line and the sum of the quantities of the pixel units 2 and the load compensation units 4 coupled to the second gate line adjacent to the first gate line may become relatively small, for example, may become three or less pixel units, or may even become zero, by compensation of the load compensation units 4 in the compensation area 3. Therefore, through the compensation of the load compensation units 4 in the compensation area 3, a smooth transition between loads of two arbitrary adjacent gate lines in the second area 12 can be realized, and the difference in load between any two gate lines is decreased, and the charge time durations thereof approach to each other, and when the display substrate displays, there is no macroscopic difference in display brightness between the pixel units 2 in the second area 12, and the display effect is improved.

In some implementations, the sum of the quantity of the load compensation units 4 coupled to any gate line in the compensation area 3 and the quantity of the pixel units 2 coupled to the any gate line in the second area 12 approaches to (e.g., equal to) the quantity of the pixel units 2 coupled to each gate line in the first area 11. With such arrangement, the difference between the quantity of each row of pixel units 2 in the second area 12 and the quantity of each row of pixel units 2 in the first area 1 can be compensated by the load compensation units 4 in the corresponding row in the compensation area 3, so that the difference in load between the gate lines in the second area 12 and the first area 11 can be reduced or eliminated, the display brightness of the pixel units 2 in the second area 12 and the first area 11 is uniform, the uniformity of the display brightness of the display substrate is improved, and the display effect of the display substrate is improved.

It should be understood that the sum of the quantity of the load compensation units 4 coupled to any gate line in the compensation area 3 and the quantity of the pixel units 2 coupled to the any gate line in the second area 12 may be smaller than the quantity of the pixel units 2 coupled to each gate line in the first area 11, as long as the difference in load between the gate lines in the second area 12 and the first area 11 is reduced, the uniformity of the display brightness of the display substrate can be improved, thereby improving the display effect of the display substrate.

In some implementations, positions of the pixel units 2 in each row in the second area 12 correspond to positions of the load compensation units 4 in each row in the compensation area 3 one by one. For example, the load compensation units 4 in the compensation area 3 and the pixel unit 2 in the second area 12, which are coupled to the same gate line, may be located in the same row. With such an arrangement, on one hand, it is convenient to ensure that each row of load compensation units 4 in the compensation area 3 exactly compensates the corresponding row of pixel units 2 in the second area 12, and it is convenient to prepare the load compensation units 4 in the compensation area 3 and the pixel units 2 in the second area 12 simultaneously in a same process, and on the other hand, it can be avoided that connection lines between the load compensation units 4 and the gate lines and the data lines are too long in distribution, thereby avoiding introduction of a relatively high power consumption by the load compensation units 4, and further ensuring the uniformity of the display brightness of the display substrate.

In the embodiment, the shape of the display area 1 may be a rectangle with an arc-shaped corner edge line of at least one corner, and the load compensation units 4 are located on a side of the arc-shaped corner edge line of the display area 1 away from the display area 1. In some implementations, the display area 1 has a shape of a rectangle with curved corner edge lines at two adjacent corners, and the load compensation units 4 are located at a side of the curved corner edge lines at two adjacent corners of the display area 1 away from the display area 1. For example, the shape of the first area 11 may be rectangular and the shape of the second area 12 may resemble a trapezoid, replacing two waists of the trapezoid with arcs. The load compensation units 4 compensate for the pixel units 2 missing from each row of pixel units 2 at arc-shaped edge lines of the second area 12 with respect to the first area 11. Certainly, the shape of the display area 1 may also be a rectangle with one corner having an arc-shaped corner edge line or a rectangle with three or four corners each having an arc-shaped corner edge line, as long as the load compensation units 4 are configured to ensure that the loads of the gate lines in the second area 12 and the first area 11 are substantially consistent.

Figure 3:
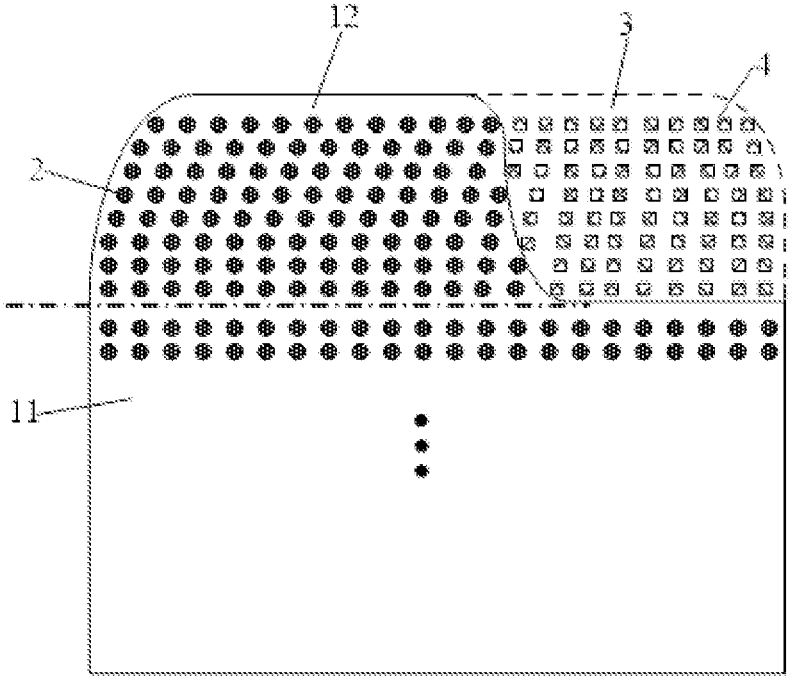
FIG. 3 is a schematic top view of a partial structure of a display substrate according to an embodiment of the present disclosure.
Figure 4:
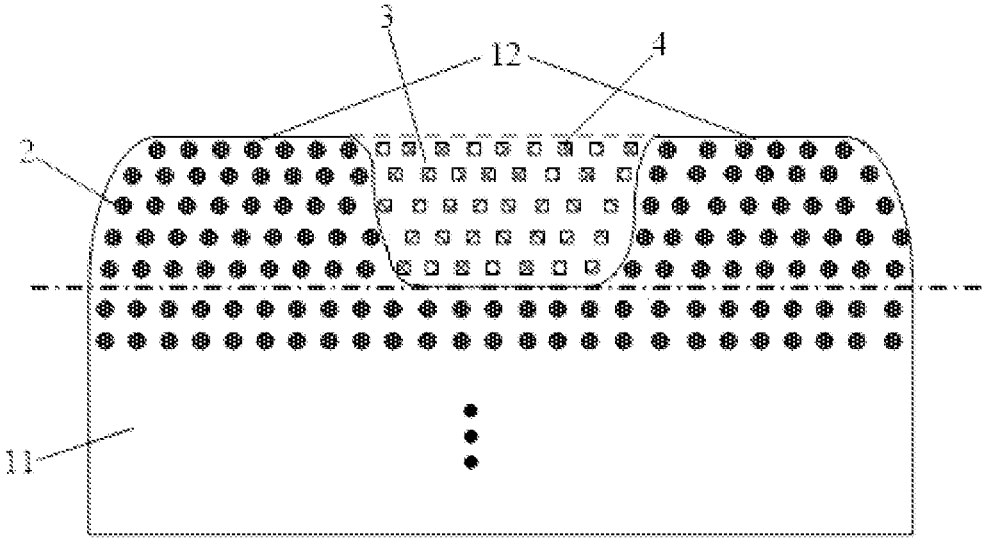
FIG. 4 is a schematic top view of a partial structure of a display substrate according to an embodiment of the present disclosure.

It should be noted that the second area 12 and the compensation area 3 may also be arranged along the first direction L, as shown in FIG. 3, in such case, the compensation area 3 and the first area 11 may be arranged along the second direction N, and the compensation area 3 may be butted with the first area 11 and the second area 12 simultaneously. Alternatively, the second area 12 may include several (e.g., two) portions that are separated from each other, as shown in FIG. 4, the portions of the second area 12 and the compensation area 3 may be arranged along the first direction L, the compensation area 3 may separate the portions of second area 12 from each other, and in such case, the compensation area 3 and the first area 11 may be arranged along the second direction N, and compensation area 3 may be butted with both the first area 11 and the second area 12.

It should be understood that, in the embodiment, shapes of the first area 11, the second area 12 and the compensation area 3 may not be specifically limited, as long as the load compensation units 4 in the compensation area 3 can compensate for the loads of the gate lines in the second area 12 to reduce or eliminate the difference in load between the gate lines in the first area 11 and the second area 12.

In the embodiment, each pixel unit 2 may include a first pixel driving circuit and a light emitting element; each load compensation unit 4 may include a second pixel driving circuit, a configuration and a structure of the second pixel driving circuit may be the same as those of the first pixel driving circuit, a scan signal input terminal of the second pixel driving circuit is coupled to the gate line, and a data signal input terminal of the second pixel driving circuit is coupled to the data line.

Since the compensation area 3 is a non-display area, no light emitting element needs to be provided in the compensation area 3. The first pixel driving circuit may be a conventional driving circuit of a light emitting element, and the first pixel driving circuit may be formed by a switching transistor, a capacitor, a driving transistor, and the like, which are not described in detail herein. The light emitting element includes an organic light emitting diode, a light emitting diode, a micro light emitting diode, a mini light emitting diode, or the like. The light emitting element is an element which can emit light autonomously under driving by the first pixel driving circuit. Since the pixel unit 2 as a main part of load is formed by the pixel driving circuit, by making the configuration and the structure of the second pixel driving circuit the same as those of the first pixel driving circuit, and the second pixel driving circuit be coupled to the corresponding gate line and the corresponding data line, the second pixel driving circuit can be normally driven to compensate the reduced load in the second area 12 relative to the first area 11, thereby realizing that the load of the gate line in the second area 12 and the load of the gate line in the first area 11 substantially tend to be the same, so that the display brightness of the pixel units 2 in the second area 12 and the first area 11 tends to be uniform, and the uniformity of the display brightness of the display substrate is improved.

In addition, the first pixel driving circuit and the second pixel driving circuit may be prepared simultaneously in a same process when the second pixel driving circuit is the same in configuration and structure as the first pixel driving circuit, and the preparation of the second pixel driving circuit does not increase preparation process steps of the display substrate additionally.

In the embodiment, in the first area 11 and the second area 12, each gate line may be input with a scan signal from one end thereof; alternatively, each gate line may be input with a scan signal from both ends thereof. That is, in the first area 11 and the second area 12, each gate line may be driven either one-sidedly or two-sidedly.

In the embodiment, the display substrate may be an organic light emitting array substrate.

Based on the above structure of the display substrate, an embodiment of the present disclosure further provides a method for driving the display substrate, including: scan signals input by gate lines in the first area drive the pixel units in the first area to display, and scan signals input by gate lines in the second area drive the pixel units in the second area to display and drive load compensation units in the compensation area.

Specifically, the scan signal input by each gate line in the second area drives the load compensation units in the compensation area and the pixel units in the second area, which are coupled to said each gate line, simultaneously.

An embodiment of the present disclosure further provides a display substrate, which is different from the display substrate of the above embodiment in that, on the basis of the display substrate of the above embodiment, in the display substrate of the present embodiment, the load compensation unit further includes a first electrode, and the first electrode is coupled to a voltage stabilization signal terminal; the first electrode and a cathode or an anode of the light emitting element may be made of a same material, and are arranged in a same layer and coupled to each other.

In the embodiment, since the compensation area is a non-display area, the load compensation unit in the compensation area does not need to emit light, the load compensation unit is provided with the second pixel driving circuit and the first electrode, and the first electrode and the cathode or the anode of the light emitting element in the second area are formed in a single patterning process, and no additional preparation process is added, and on the basis that the load compensation unit includes only the second pixel driving circuit in the above embodiment, the contribution of the load compensation unit as a load can be further increased, so that each compensation unit serving as a load is more similar to one pixel unit serving as a load, thereby further improving the difference between the load of the gate line in the second area and the load of the gate line in the first area, the display brightness of the pixel units in the second area and the first area is more uniform, and the uniformity of the display brightness of the display substrate is further improved, the display effect of the display substrate is improved.

Other structures of the display substrate and the method for driving the display substrate in the present embodiment are the same as those in the above embodiments, and are not described herein again.

The display substrate provided by the embodiment of the present disclosure can compensate the load of the gate line in the second area by arranging the compensation area and arranging the load compensation units in the compensation area to reduce the difference in load between the gate lines in the second area and the first area, so that the load of the gate line in the second area and the load of the gate line in the first area substantially tend to be the same, further, the charging time durations of the rows of pixel units in the second area and the first area tend to be the same, the difference in current between the rows of pixel units in the second area and the first area tends to be zero, finally, the display brightness of the pixel units in the second area and the first area tends to be uniform, the uniformity of the display brightness of the display substrate is improved, and the display effect of the display substrate is improved.

An embodiment of the present disclosure further provides a display device including the display substrate in the above embodiment.

By adopting the display substrate in the embodiment, the uniformity of the display brightness of the display device is improved, and the display effect of the display device is improved.

The display device provided by the embodiment of the present disclosure can be any product or component with a display function, such as an OLED panel, an OLED television, an LED panel, an LED television, a Micro-LED panel, a Micro-LED television, a Mini-LED panel, a Mini-LED television, a display, a mobile phone, and a navigator.

It is to be understood that the above embodiments and implementations are merely illustrative of exemplary embodiments and implementations that have been employed to illustrate the principles of the present disclosure, which, however, is not to be taken as limiting of the present disclosure. It will be apparent to those skilled in the art that various changes and modifications can be made therein without departing from the spirit and scope of the present disclosure, and these changes and modifications are to be considered within the scope of the present disclosure.

The invention claimed is:

1. A display substrate, comprising a display area, pixel units arranged in an array, gate lines extending along a first direction and data lines extending along a second direction are arranged in the display area, the gate lines and the data lines are crossed, the pixel units arranged along the first direction are coupled through the gate lines, and the pixel units arranged along the second direction are coupled through the data lines;

the display area comprises a first area and a second area which are mutually butted, the first area and the second area are arranged along the second direction, quantities of the pixel units arranged along the first direction in the first area are the same, and a quantity of the pixel units in any row arranged along the first direction in the second area is less than that of the pixel units in any row arranged along the first direction in the first area;

the display substrate further comprises a compensation area, the compensation area is in butt joint with the second area, a load compensation unit is arranged in the compensation area, the gate line in the second area extends to the compensation area, the data line in the first area extends to the compensation area, and the load compensation unit is coupled with the gate line and the data line, wherein the first direction is a row direction of the array, and the second direction is a column direction of the array;

a plurality of rows of pixel units are arranged in the second area, each row of pixel units comprises a plurality of pixel units, and quantities of the pixel units in the rows are gradually reduced along a direction of the second area away from the first area;

a plurality of rows of load compensation units are arranged in the compensation area, and the rows of load compensation units are arranged along a direction in which the data line extends; each row of load compensation units comprises a plurality of load compensation units, and the load compensation units in each row are arranged along a direction in which the gate line extends;

quantities of the load compensation units in the rows in the compensation area are gradually increased along a direction away from the first area;

along the direction away from the first area, the rows of the pixel units in the second area correspond to the rows of the load compensation units in the compensation area one by one, and the pixel units and the load compensation units in the corresponding rows are coupled with the same gate line.

2. The display substrate of claim 1, wherein the load compensation unit compensates a resistance and a capacitance of a load of the gate line.

3. The display substrate of claim 1, wherein a difference between a sum of quantities of the pixel units and load compensation units coupled to a first gate line and a sum of quantities of the pixel units and load compensation units coupled to a second gate line adjacent to the first gate line is less than or equal to a difference between the quantity of the pixel units coupled to the first gate line and the quantity of the pixel units coupled to the second gate line.

4. The display substrate of claim 1, wherein a sum of a quantity of load compensation units coupled to any gate line in the compensation area and a quantity of the pixel units coupled to the any gate line in the second area is less than or equal to a quantity of the pixel units coupled to each gate line in the first area.

5. The display substrate of claim 1, wherein positions of the pixel units in each row in the second area correspond to positions of the load compensation units in each row in the compensation area one by one.

6. The display substrate of claim 1, wherein the first area, the second area, and the compensation area are arranged along the second direction.

7. The display substrate of claim 1, wherein the second area and the compensation area are arranged along the first direction, and the compensation area is further in butt joint with the first area.

8. The display substrate of claim 1, wherein each of the pixel units comprises a first pixel driving circuit and a light emitting element;

each load compensation unit comprises a second pixel driving circuit, a configuration and a structure of the second pixel driving circuit are the same as those of the first pixel driving circuit, a scan signal input terminal of the second pixel driving circuit is coupled with the gate line, and a data signal input terminal of the second pixel driving circuit is coupled with the data line.

9. The display substrate of claim 8, wherein the load compensation unit further comprises a first electrode coupled to a voltage stabilization signal terminal;

the first electrode and a cathode or an anode of the light emitting element are made of a same material, and are arranged in a same layer and coupled to each other.

10. The display substrate of claim 8, wherein the light emitting element comprises an organic light emitting diode, a light emitting diode, a micro light emitting diode, or a mini light emitting diode.

11. The display substrate of claim 1, wherein each gate line is input with a scan signal from one end thereof; or, each gate line is input with a scan signal from both ends thereof.

12. A display device, comprising the display substrate of claim 1.

13. A method for driving the display substrate of claim 1, the method comprising:

driving the pixel units in the first area to display by scan signals input through gate lines in the first area;

driving the pixel units in the second area to display, and driving load compensation units in the compensation area by scan signals input through gate lines in the second area.

14. The driving method of claim 13, further comprising:

driving the load compensation units in the compensation area and the pixel units in the second area, which are coupled to each gate line, simultaneously, by a scan signal input by said each gate line.

15. A display substrate, comprising a display area, pixel units arranged in an array, gate lines extending along a first direction and data lines extending along a second direction are arranged in the display area, the gate lines and the data lines are crossed, the pixel units arranged along the first direction are coupled through the gate lines, and the pixel units arranged along the second direction are coupled through the data lines;

the display area comprises a first area and a second area which are mutually butted, the first area and the second area are arranged along the second direction, quantities of the pixel units arranged along the first direction in the first area are the same, and a quantity of the pixel units in any row arranged along the first direction in the second area is less than that of the pixel units in any row arranged along the first direction in the first area;

the display substrate further comprises a compensation area, the compensation area is in butt joint with the second area, a load compensation unit is arranged in the compensation area, the gate line in the second area extends to the compensation area, the data line in the first area extends to the compensation area, and the load compensation unit is coupled with the gate line and the data line, wherein each of the pixel units comprises a first pixel driving circuit and a light emitting element;

each load compensation unit comprises a second pixel driving circuit, a configuration and a structure of the second pixel driving circuit are the same as those of the first pixel driving circuit, a scan signal input terminal of the second pixel driving circuit is coupled with the gate line, and a data signal input terminal of the second pixel driving circuit is coupled with the data line, and wherein the load compensation unit further comprises a first electrode coupled to a voltage stabilization signal terminal;

the first electrode and a cathode or an anode of the light emitting element are made of a same material, and are arranged in a same layer and coupled to each other.

* * * * *